US010271152B1

(12) United States Patent
Tong et al.

(10) Patent No.: US 10,271,152 B1
(45) Date of Patent: Apr. 23, 2019

(54) SYNCHRONIZATION OF WIRELESS HEADPHONES

(71) Applicant: Bestechnic (Shanghai) Co., Ltd., Shanghai (CN)

(72) Inventors: Weifeng Tong, Shanghai (CN); Dongsheng Cui, Shanghai (CN); Hua Zeng, Shanghai (CN); Yulong Wang, Shanghai (CN)

(73) Assignee: BESTECHNIC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/211,180

(22) Filed: Dec. 5, 2018

Related U.S. Application Data

(63) Continuation of application No. 15/939,258, filed on Mar. 28, 2018, now Pat. No. 10,200,803.

(30) Foreign Application Priority Data

Jan. 23, 2018 (CN) ..... 2018 1 0064163

(51) Int. Cl.
*H04S 1/00* (2006.01)
*H04R 1/10* (2006.01)

(52) U.S. Cl.
CPC ..... *H04S 1/005* (2013.01); *H04R 1/1091* (2013.01); *H04R 2420/07* (2013.01)

(58) Field of Classification Search
CPC ..... H04R 25/55; H04R 25/552; H04R 2225/021; H04R 1/1091; H04R 2420/07; H04S 1/005
USPC ..... 381/22, 23, 23.1, 56, 58, 311
See application file for complete search history.

(56) References Cited

U.S. PATENT DOCUMENTS

| | | | | |
|---|---|---|---|---|
| 2009/0097593 | A1 | 4/2009 | Hamaminato et al. | |
| 2014/0328235 | A1* | 11/2014 | Merlin | H04L 1/18 370/311 |
| 2016/0034886 | A1 | 2/2016 | Boesen | |
| 2016/0269136 | A1 | 9/2016 | Fair et al. | |
| 2016/0323672 | A1 | 11/2016 | Bhogal et al. | |
| 2017/0098466 | A1* | 4/2017 | Elliot | G11B 27/10 |
| 2017/0277507 | A1* | 9/2017 | Ando | G06F 3/165 |
| 2017/0287495 | A1* | 10/2017 | Tada | G10L 19/167 |

* cited by examiner

*Primary Examiner* — William A Jerez Lora
(74) *Attorney, Agent, or Firm* — Bayes PLLC

(57) ABSTRACT

Embodiments of wireless audio systems and methods for synchronizing wireless headphones are disclosed herein. In one example, a wireless audio system includes an audio source, a first wireless headphone, and a second wireless headphone. The audio source is configured to separately transmit a left-channel audio signal and a right-channel audio signal using a short-range wireless communication protocol. The first wireless headphone is configured to receive the left-channel audio signal and synchronize a first clock of the first wireless headphone with the audio source based on the left-channel audio signal. The second wireless headphone is configured to receive the right-channel audio signal and synchronize a second clock of the second wireless headphone with the audio source based on the right-channel audio signal, so that the first clock of the first wireless headphone is synchronized with the second clock of the second wireless headphone.

14 Claims, 9 Drawing Sheets

SYNCHRONIZATION OF WIRELESS HEADPHONES

CROSS-REFERENCE TO RELATED APPLICATIONS

This application is a continuation of U.S. application Ser. No. 15/939,258, filed on Mar. 28, 2018, entitled "SYNCHRONIZATION OF WIRELESS HEADPHONES," and claims the benefit of priority to Chinese Patent Application No. 201810064163.4 filed on Jan. 23, 2018, both of which are incorporated herein by reference in their entireties.

BACKGROUND

Embodiments of the present disclosure relate to wireless audio systems.

Loudspeakers, including headphones, have been widely used in daily life. Headphones are a pair of small loudspeaker drivers worn on or around the head over a user's ears, which convert an electrical signal to a corresponding sound.

Wired headphones, however, constrain the users' movement because of the wires (cords), and are particularly inconvenient during exercise. Conventional wireless headphones no longer need the wires between the headphones and the audio sources, but still require the wires between the left and right headphones.

SUMMARY

Embodiments of wireless audio systems and methods for synchronizing wireless headphones are disclosed herein.

In one example, a wireless audio system includes an audio source, a first wireless headphone, and a second wireless headphone. The audio source is configured to separately transmit a left-channel audio signal and a right-channel audio signal using a short-range wireless communication protocol. The first wireless headphone is configured to receive the left-channel audio signal and synchronize a first clock of the first wireless headphone with the audio source based on the left-channel audio signal. The second wireless headphone is configured to receive the right-channel audio signal and synchronize a second clock of the second wireless headphone with the audio source based on the right-channel audio signal, so that the first clock of the first wireless headphone is synchronized with the second clock of the second wireless headphone.

In another example, a wireless audio system includes a first wireless headphone and a second wireless headphone. The first wireless headphone is configured to receive, from an audio source, a left-channel audio signal using a short-range wireless communication protocol and synchronize a first clock of the first wireless headphone with the audio source based on the left-channel audio signal. The second wireless headphone is configured to receive, from the audio source, a right-channel audio signal using the short-range wireless communication protocol and synchronize a second clock of the second wireless headphone with the audio source based on the right-channel audio signal, so that the first clock of the first wireless headphone is synchronized with the second clock of the second wireless headphone. The left-channel audio signal and the right-channel audio signal are separated from a same stereo audio information.

In a different example, a method for synchronizing wireless headphones is disclosed. A left-channel audio signal is received, by a first wireless headphone, from an audio source using a short-range wireless communication protocol. A first clock of the first wireless headphone is synchronized, by the first wireless headphone, with the audio source based on the left-channel audio signal. A right-channel audio signal is received, by a second wireless headphone, from the audio source using the short-range wireless communication protocol. A second clock of the second wireless headphone is synchronized, by the second wireless headphone, with the audio source based on the right-channel audio signal, so that the first clock of the first wireless headphone is synchronized with the second clock of the second wireless headphone. The left-channel audio signal and the right-channel audio signal are separated from a same stereo audio information.

This Summary is provided merely for purposes of illustrating some embodiments to provide an understanding of the subject matter described herein. Accordingly, the above-described features are merely examples and should not be construed to narrow the scope or spirit of the subject matter in this disclosure. Other features, aspects, and advantages of this disclosure will become apparent from the following Detailed Description, Figures, and Claims.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1:
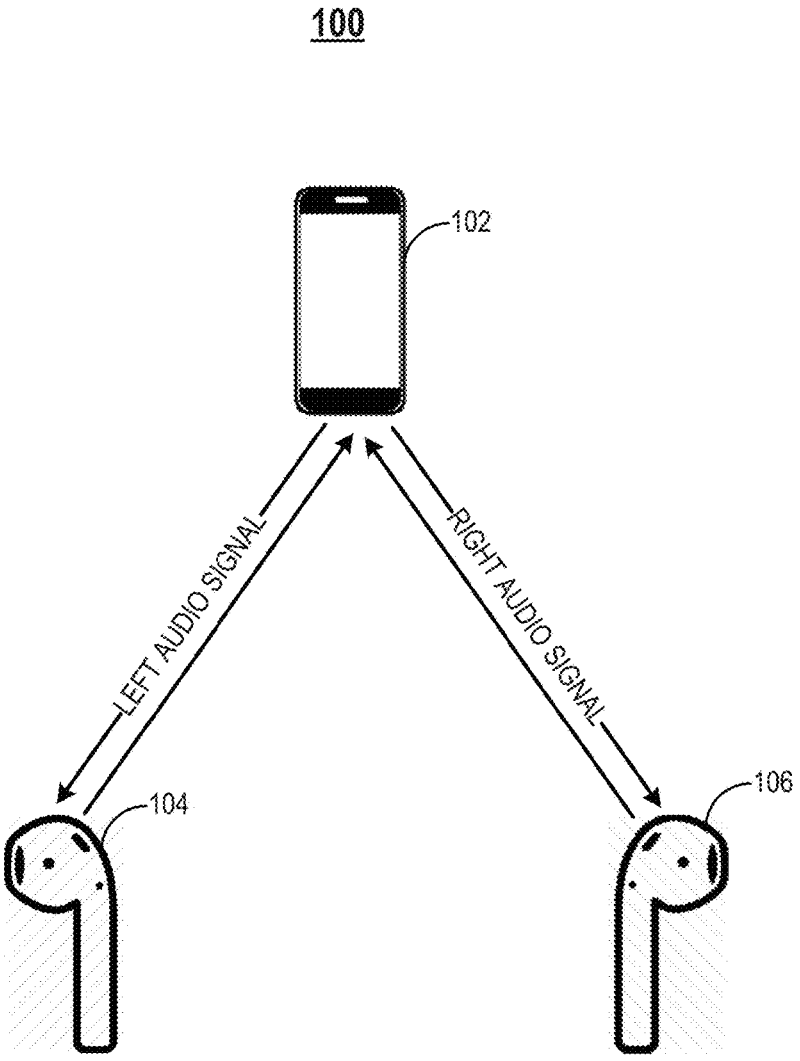
FIG. 1 is a block diagram illustrating an exemplary wireless audio system in accordance with an embodiment.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

Although specific configurations and arrangements are discussed, it should be understood that this is done for illustrative purposes only. It is contemplated that other configurations and arrangements can be used without departing from the spirit and scope of the present disclosure. It is further contemplated that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it is contemplated that such feature, structure or characteristic may also be used in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

True wireless stereo (TWS) headphones (also known as untethered headphones) is a type of wireless headphones that remove the wires between the left and right headphones. For some TWS headphones, an audio source transmits data (music, audio, or data packets) to the left-ear headphone and the right-ear headphone, respectively. In the example of playing stereo music, the audio source can respectively transmit the music data to the left-ear headphone and right-ear headphone. However, since the left-ear headphone and right-ear headphone are two separate devices each having its own chip with a local clock, it is difficult to synchronize the left-ear and right-ear headphones directly by themselves. As a result, when playing stereo music, the left-channel music and right-channel music are hard to be played synchronously, thereby affecting the user's listening experience.

As will be disclosed in detail below, among other novel features, the wireless audio systems disclosed herein can achieve "true wireless stereo" with improved listening experience and reduced headphone power consumption. In some embodiments of the present disclosure, each of the left-ear and right-ear headphones achieves clock synchronization with the audio source, thereby synchronizing the local clocks of the left-ear and right-ear headphones as well. For example, the timing error between the left-ear and right-ear headphones may be reduced to less than 1 μs. This "indirect" synchronization can ensure that the left-ear and right ear headphones play music synchronously, for example, with the delay between the two ears being less than 1 μs, which greatly improves the user's listening experience.

In some embodiments of the present disclosure, the audio source separates the left-channel audio information and the right-channel audio information from the same stereo audio and separately transmits the left-channel audio signal and right-channel audio signal to the left-ear headphone and right-ear headphone, respectively. Because data in only one audio channel needs to be transmitted, the amount of data transmitted between the audio source and each of the left-ear and right-ear headphones can be reduced. As a result, the power consumption of the audio source can be reduced, and the data transmission reliability can be improved with more retransmission times available. In some embodiments, Opus codec, which has a high encoding efficiency, may be used to separately encode the left-channel audio information and right-channel audio information to further reduce the power consumption of the audio source and improve the data transmission reliability.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 is a block diagram illustrating an exemplary wireless audio system 100 in accordance with an embodiment. Wireless audio system 100 may include an audio source 102, a first wireless headphone 104, and a second wireless headphone 106. Audio source 102 may be any suitable device that can provide audio information including, for example, music or voice in the digital or analog format. Audio source 102 may include, but is not limited to, a handheld device (e.g., dumb or smart phone, tablet, etc.), a wearable device (e.g., eyeglasses, wrist watch, etc.), a radio, a music player, an electronic musical instrument, an automobile control station, a gaming console, a television set, a laptop computer, a desktop computer, a netbook computer, a media center, a set-top box, a global positioning system (GPS), or any other suitable device. First wireless headphone 104 and second wireless headphone 106 may be a pair of loudspeakers that can be worn on or around the head over a user's ears. First wireless headphone 104 and second wireless headphone 106 may be any electroacoustic transducers that convert an electrical signal (e.g., representing the audio information provided by audio source 102) to a corresponding sound. First wireless headphone 104 may be worn over the user's left ear and referred to herein as a left-ear headphone, and second wireless headphone 106 may be worn over the user's right ear and referred to herein as a right-ear headphone. It is understood that first wireless headphone 104 and second wireless headphone 106 may have the same hardware structures and thus, can switch sides as needed. In some embodiments, each of first wireless headphone 104 and second wireless headphone 106 may be an earbud (also known as earpiece) that can plug into the user's ear canal. In some embodiments, first wireless headphone 104 and second wireless headphone 106 may be TWS headphones, which are individual units that are not physically held by a band over the head and/or electrically connected by a cord. First wireless headphone 104 and/or second wireless headphone 106 may be combined with a microphone to form a headset according to some embodiments. It is understood that although in FIG. 1, wireless audio system 100 includes both audio source 102 and the pair of first and second wireless headphones 104 and 106, in some embodiments, wireless audio system 100 may include only first wireless headphone 104 and second wireless headphone 106.

As shown in FIG. 1, bidirectional communications may be established between audio source 102 and first wireless headphone 104 and between audio source 102 and second wireless headphone 106. Audio source 102 may separate stereo audio information (e.g., stereo music) into left-channel audio information and right-channel audio information. In some embodiments, audio source 102 may generate or receive a stream of stereo audio information in the form of compressed or uncompressed stereo samples for multiple audio channels, such as left audio channel and right audio channel or the like. Audio source 102 may further generate a left-channel audio signal and a right-channel audio signal based on the left-channel audio information and the right-channel audio information, respectively. For example, audio source 102 may separately modulate the left-channel audio information (e.g., in data packets) and right-channel audio information (e.g., in data packets) by radio frequency (RF) carrier waves using a short-range wireless communication protocol (e.g., the Bluetooth protocol or WiFi protocol). Audio source 102 may separately transmit the left-channel audio signal to first wireless headphone 104 and the right-channel audio signal to second wireless headphone 106. That is, audio source 102 may not transmit the entire audio information (e.g., both the left-channel audio information and right-channel audio information) to first wireless headphone 104 or second wireless headphone 106. Instead, only audio information in one of the multiple audio channels may be transmitted, in the form of the left-channel or right-channel audio data, to first wireless headphone 104 or second wireless headphone 106. As a result, the power consumption of audio source 102 in transmitting the audio signals to first wireless headphone 104 and second wireless headphone 106 can be reduced due to the reduction of the transmitted data packets. Moreover, by transmitting only the left-channel or right-channel audio signal, the available number of retransmission can be increased, thereby increasing the reliability of data transmission.

As shown in FIG. 1, first wireless headphone 104 may transmit acknowledgement packets back to audio source 102 upon successful reception of the left-channel audio signal from audio source 102. Similarly, second wireless headphone 106 may transmit acknowledgement packets back to audio source 102 upon successful reception of the right-channel audio signal from audio source 102. In some embodiments, each of first wireless headphone 104 and second wireless headphone 106 may transmit an identifier to audio source 102 to identify whether it is a left-ear headphone or a right-ear headphone. For example, first wireless headphone 104 may transmit an identifier indicative of a left side to audio source 102, and second wireless headphone 106 may transmit another identifier indicative of a right side to audio source 102. Based on the received identifiers, audio source 102 may determine the corresponding destinations to transmit the left-channel audio signal and right-channel audio signal according to some embodiments.

In some embodiments, the corresponding left-channel audio signal and right-channel audio signal may be separately transmitted from audio source 102 to first wireless headphone 104 and second wireless headphone 106 according to the Bluetooth protocol at the working RF band between 2402 MHz and 2480 MHz or between 2400 MHz and 2483.5 MHz (referred to herein as "2.4 GHz"). Bluetooth is a wireless technology standard for exchanging data over short distances, and the Bluetooth protocol is one example of short-range wireless communication protocols. In one example, audio source 102 may apply the advanced audio distribution profile (A2DP) of the Bluetooth protocol for separately transmitting the left-channel audio signal and right-channel audio signal to first wireless headphone 104 and second wireless headphone 106, respectively. For example, based on the A2DP, a Bluetooth audio streaming of the left-channel music or voice may be streamed from audio source 102 to first wireless headphone 104 over a Bluetooth connection, and another Bluetooth audio streaming of the right-channel music or voice may be streamed from audio source 102 to second wireless headphone 106 over another Bluetooth connection. It is understood that any other suitable profiles in the Bluetooth protocol, such as the audio/video remote control profile (AVRCP), may be used in conjunction with the A2DP to remote control first wireless headphone 104 and/or second wireless headphone 106.

In some embodiments, the corresponding left-channel audio signal and right-channel audio signal may be separately transmitted from audio source 102 to first wireless headphone 104 and second wireless headphone 106 according to the WiFi protocol at the working RF band of 2.4 GHz or 5 GHz. WiFi is a wireless technology for wireless local area networking based on the IEEE 802.11 standards, and the WiFi protocol (also known as the 802.11 protocol) is another example of short-range wireless communication protocols. It is understood that the communications between audio source 102 and first wireless headphone 104 and between audio source 102 and second wireless headphone 106 may be any other suitable short-range wireless communication in addition to Bluetooth and WiFi.

As shown in FIG. 1, first wireless headphone 104 and second wireless headphone 106 may be two separate devices that do not communication with one another directly. Thus, it may be difficult for first wireless headphone 104 and second wireless headphone 106 to synchronize with one another directly. In this example, first wireless headphone 104 and second wireless headphone 106 may be indirectly synchronized via audio source 102. In some embodiments, the local clock of first wireless headphone 104 may be synchronized with audio source 102 based on the left-channel audio signal transmitted from audio source 102 to first wireless headphone 104, and the local clock of second wireless headphone 106 may be synchronized with audio source 102 as well based on the right-channel audio signal transmitted from audio source 102 to second wireless headphone 106. As both local locks of first and second wireless headphones 104 and 106 are synchronized with audio source 102, the local clock of first wireless headphone 104 is also synchronized with the local clock of second wireless headphone 106. The detail of synchronizing the local clock of first wireless headphone 104 or second wireless headphone 106 is described below.

Figure 2:
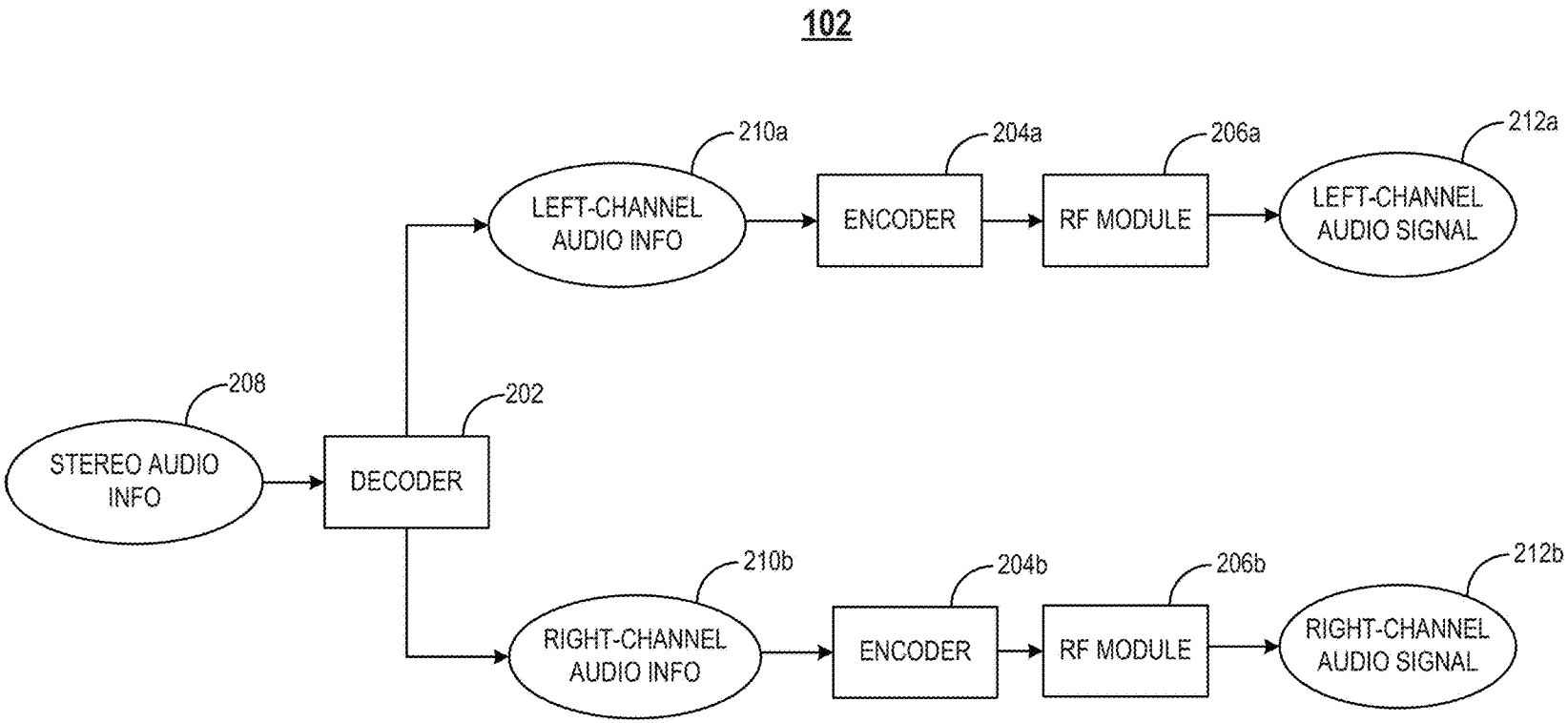
FIG. 2 is a block diagram illustrating an exemplary audio source in accordance with an embodiment.

FIG. 2 is a block diagram illustrating exemplary audio source 102 in accordance with an embodiment. In this example, audio source 102 includes a decoder 202, an encoder 204, and an RF module 206. Some or all of decoder 202, encoder 204, and RF module 206 may be in the same integrated circuit (IC) chip, such as in an application processor (AP). It is understood that additional module(s) may be included in audio source 102, either in the same IC chip in which decoder 202, encoder 204, and/or RF module 206 are formed or in a separate IC chip, for converting stereo audio information 208 into a left-channel audio signal **212*a* and a right-channel audio signal 212*b* and separately transmitting left-channel audio signal 212*a* and right-channel audio signal 212*b*** via an antenna (not shown).

In some embodiments, audio source 102 may receive or generate stereo audio information 208 in multiple audio channels, such as stereo music or voice. For example, stereo audio information 208 may be in the form of compressed or uncompressed stereo samples in two audio channels, such as the left audio channel and right audio channel, or in more than two audio channels, such as the left, central, and right audio channels. In some embodiments, stereo audio information 208 may be stereo audio that has already been encoded by any encoding schemes. Decoder 202 may be configured to decode stereo audio information 208 by the corresponding decoding schemes and separate decoded stereo audio information 208 into left-channel audio information 210*a* and right-channel audio information 210*b*. Encoder 204 may be operatively coupled to decoder 202 and configured to separately encode left-channel audio information 210*a* and right-channel audio information 210*b*. For example, encoder 204*a* may be configured to encode left-channel audio information 210*a*, and encoder 204*b* may be configured to encode right-channel audio information 210*b*. In some embodiments, encoder 204 may apply Opus codec for encoding left-channel audio information 210*a* and right-channel audio information 210*b*.

RF module 206 may be operatively coupled to encoder 204 and configured to generate left-channel audio signal 212*a* based on encoded left-channel audio information 210*a* and generate right-channel audio signal 212*b* based on encoded right-channel audio information 210*b*. RF module 206 may be further configured to separately transmit left-channel audio signal 212*a* and right-channel audio signal 212*b*. Left-channel audio information 210*a* and right-channel audio information 210*b* may be transmitted using a short-range wireless communication protocol, such as the Bluetooth or WiFi protocol. In some embodiments, RF module 206*a* may modulate encoded left-channel audio information 210*a* using the carrier wave at the frequency, for example, at 2.4 GHz for Bluetooth or WiFi communication, and transmit left-channel audio signal 212*a* at the Bluetooth or WiFi working RF band via the antenna. Similarly, RF module 206*b* may modulate encoded right-channel audio information 210*b* using the carrier wave at the frequency, for example, at 2.4 GHz for Bluetooth or WiFi communication, and transmit right-channel audio signal 212*b* at the Bluetooth or WiFi working RF band via the antenna. RF module 206*a* and RF module 206*b* may simultaneously transmit left-channel audio signal 212*a* and right-channel audio signal 212*b*. RF module 206 may include a physical layer module for generating baseband packets (e.g., Bluetooth packets) based on the music and/or voice data (payload) and performing error correction using any known methods, such as forward error correction (FEC) and automatic repeat request (ARQ). RF module 206 may also include a media access control (MAC) layer module for generating the logical data channel links. RF module 206 may further include a host controller interface (HCI) for providing a common interface to the physical layer module and MAC layer module and access to hardware status and control registers.

Figure 3:
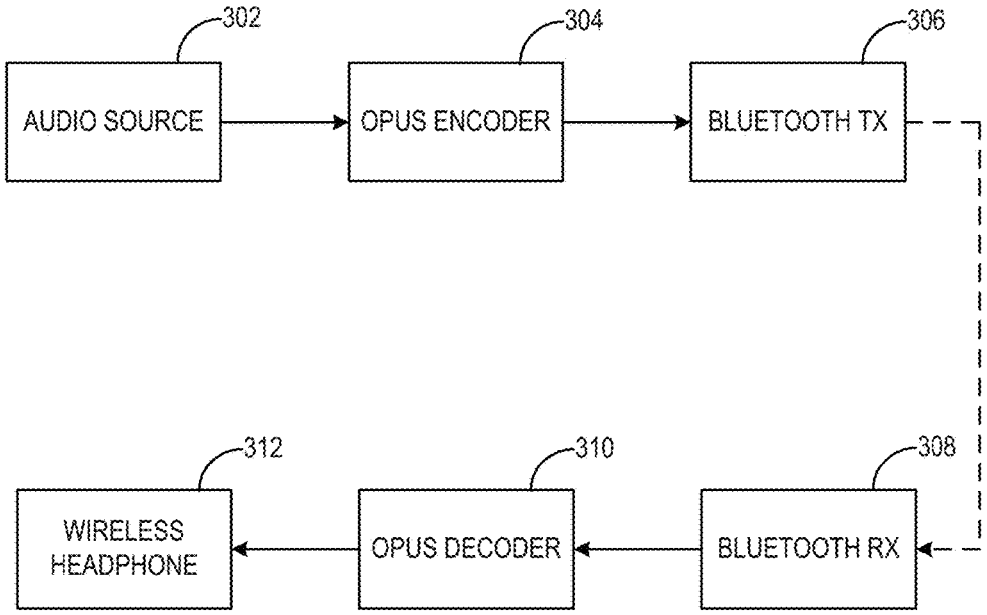
FIG. 3 is a diagram illustrating an exemplary process of transmitting audio information encoded by Opus codec using the Bluetooth protocol in accordance with an embodiment.

FIG. 3 is a diagram illustrating an exemplary process of transmitting audio information encoded by Opus codec using the Bluetooth protocol in accordance with an embodiment. In this example, an audio source 302 (e.g., audio source 102) may provide left-channel audio information and right-channel audio information. Left-channel audio information or right-channel audio information may be encoded by an Opus encoder 304 of audio source 302. Opus is a lossy audio coding format for efficiently coding speech and general audio in a single format, while remaining low-latency enough for real-time interactive communication and low-complexity enough for low-end embedded processors. The encoded left-channel audio information or right-channel audio information may be transmitted by a Bluetooth transmitter 306 of audio source 302 in the form of a single-channel Bluetooth audio signal (e.g., via the A2DP) to a Bluetooth receiver 308 of a wireless headphone 312. The received single-channel Bluetooth audio signal may be decoded by an Opus decoder 310. The decoded single-channel audio information may be played by wireless headphone 312 (e.g., first wireless headphone 104 or second wireless headphone 106) as a single-channel music and/or voice.

Figure 4:
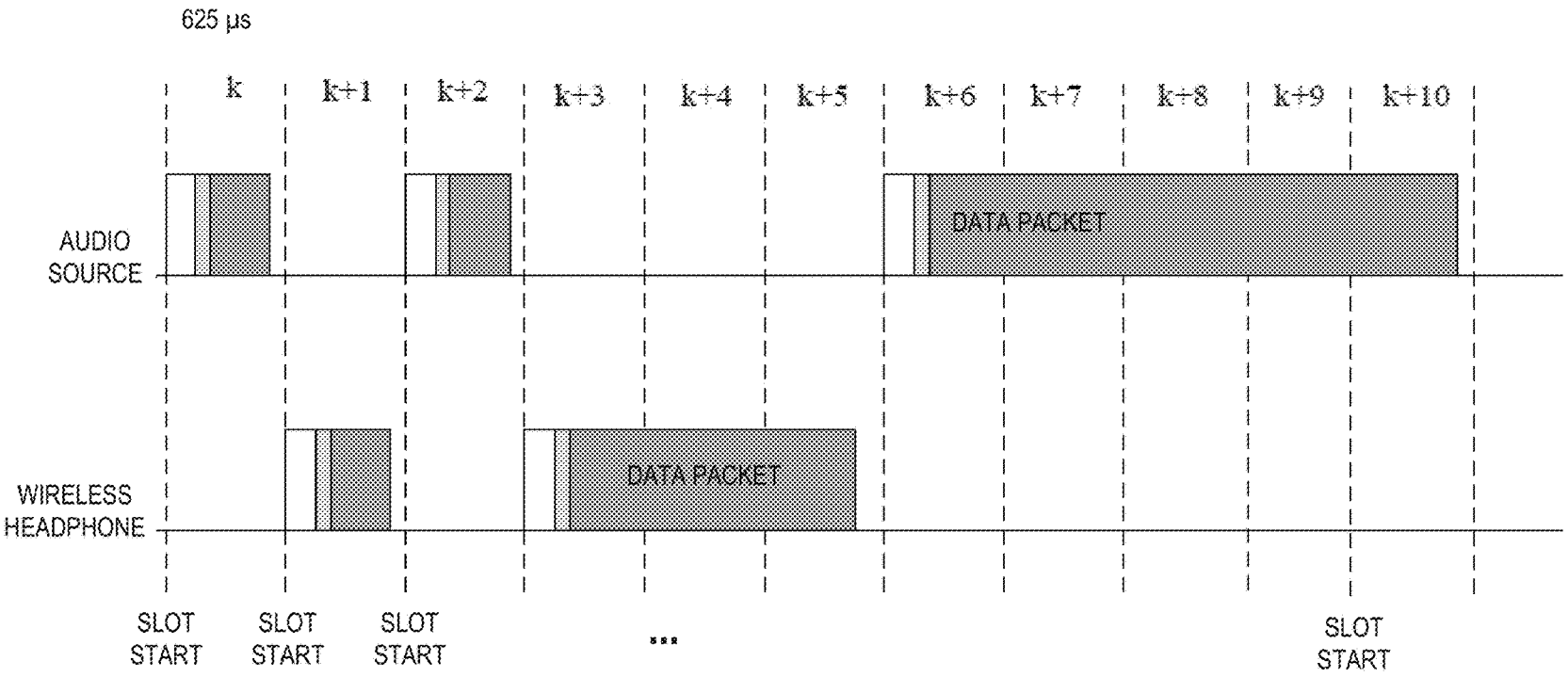
FIG. 4 is a timing diagram illustrating an exemplary multiple-slot packets transmission in accordance with an embodiment.
Figure 5:
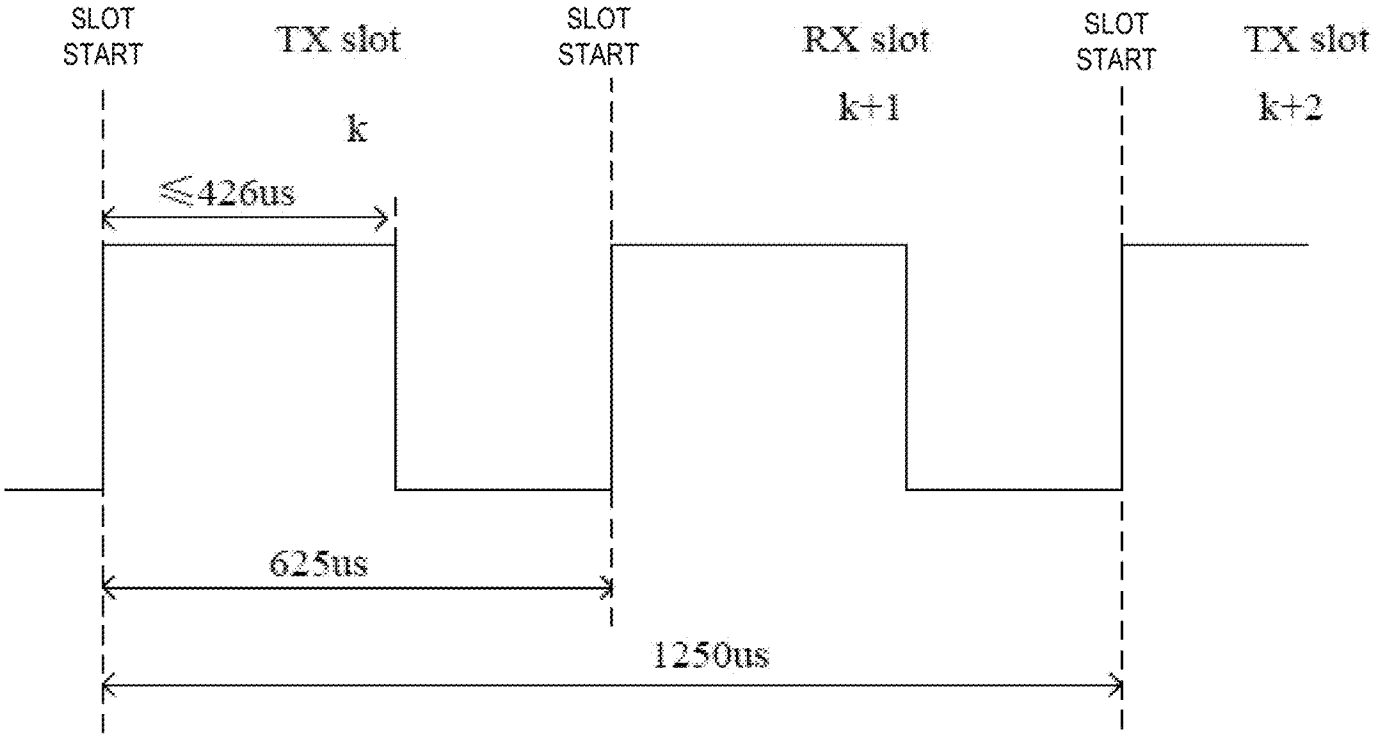
FIG. 5 is a timing diagram illustrating an exemplary single-slot packets transmission in accordance with an embodiment.

In the example that each of the left-channel audio signal and right-channel audio signal is transmitted using the Bluetooth protocol, the physical channel of the Bluetooth connection is divided into time slots, each of which has the same length (e.g., 625 μs). The time slots may be numbered according to the most significant 27 bits of the Bluetooth clock of the audio source transmitting the Bluetooth single-channel audio signal. FIG. 4 is a timing diagram illustrating an exemplary multiple-slot packets transmission in accordance with an embodiment. FIG. 5 is a timing diagram illustrating an exemplary single-slot packets transmission in accordance with an embodiment. As shown in FIGS. 4 and 5, each time slot k has the same length (e.g., 625 μs), and the start of transmitting each data packet is aligned with the slot start, regardless of the number of time slots that the data packet extends over (e.g., for multiple-slot packets transmission).

Figure 6:
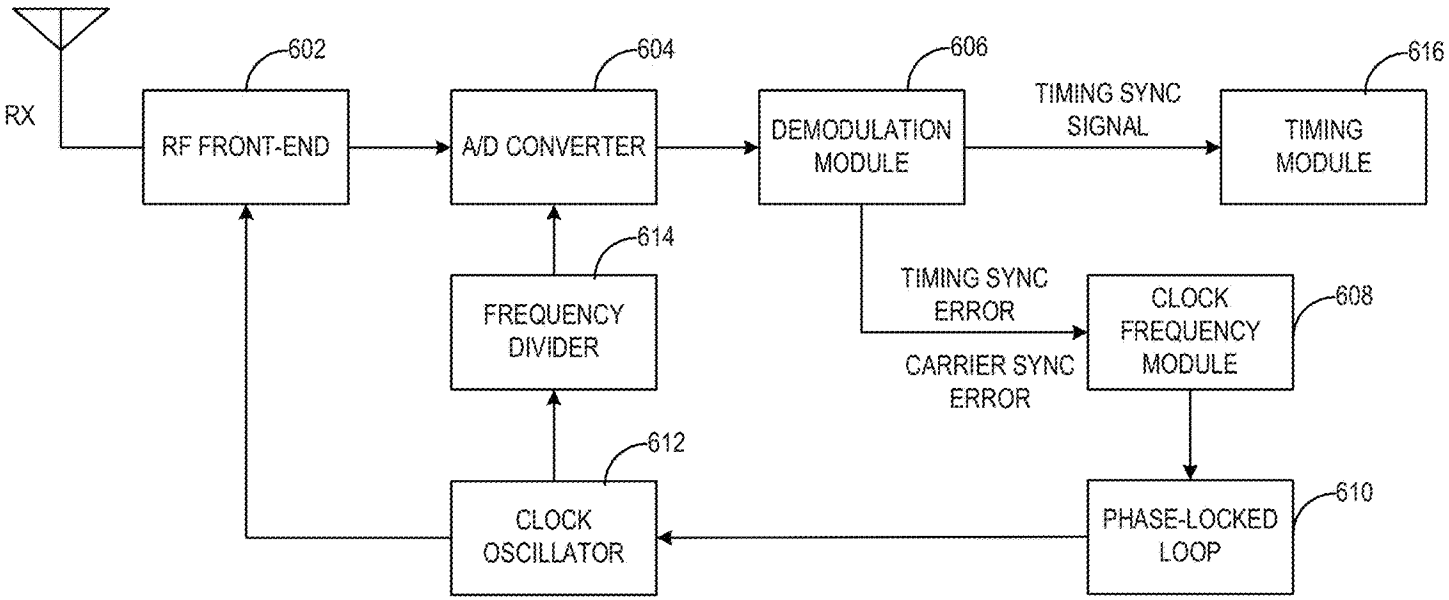
FIG. 6 is a block diagram illustrating an exemplary wireless headphone in accordance with an embodiment.

FIG. 6 is a block diagram illustrating exemplary wireless headphone 104 or 106 in accordance with an embodiment. In this example, each of first wireless headphone 104 and second wireless headphone 106 includes an RF front-end 602, an analog-to-digital (A/D) converter 604, a demodulation module 606, a clock frequency module 608, a phase-locked loop (PLL) 610, a clock oscillator 612, a frequency divider 614, and a timing module 616. RF front-end 602 may be operatively coupled to an antenna and configured to receive the RF signals, such as the left-channel audio signal or the right-channel audio signal as described above in detail. RF front-end 602 may include an antenna switch, low-noise amplifier (LNA), power amplifier (PA), filter, etc. A/D converter 604 may be operatively coupled to RF front-end 602 and configured to convert the left-channel audio signal or the right-channel audio signal from an analog signal to a digital signal and provide the digital left-channel or right-channel audio signal to demodulation module 606 that is operatively coupled to A/D converter 604. The A/D conversion may be performed by A/D converter 604 based on an A/D sampling rate determined by frequency divider 614.

In this example, demodulation module 606 may be configured to obtain at least one synchronization error based on the received left-channel audio signal or right-channel audio signal (e.g., in the digital form). The synchronization error may include a timing synchronization error and a carrier synchronization error. For example, in the Bluetooth communication, the timing synchronization error may be the timing offset between the local sequence in first wireless headphone 104 or second wireless headphone 106 and the known sequence (e.g., the access code, including the preamble code and synchronization code, according to the Bluetooth protocol) in the received single-channel audio signal from the audio source. In some embodiments, demodulation module 606 may obtain a timing synchronization signal from the received single-channel audio signal as well. Demodulation module 606 may perform the synchronization function to calculate the timing synchronization error. In some embodiments, the timing synchronization error may be obtained for each of the time slots in which the single-channel audio signal is transmitted if the single-channel audio signal is transmitted by the single-slot packets transmission. It is understood that the single-slot packets transmission rate may be higher than the single-channel audio signal transmission rate since not all the time slots may be used for transmitting the single-channel audio signal. For example, the kth time slot may be used for transmitting a single-channel audio signal from the audio source, while the (k+l)th time slot may be used for transmitting an acknowledgement to the audio source. In some embodiments, the timing synchronization error may be obtained for each of the multiple time slots (occupied by a single data packet) in which the single-channel audio signal is transmitted if the single-channel audio signal is transmitted by the multiple-slots packets transmission. In the example of the Bluetooth communication, the timing synchronization error may be calculated based on a sequence known by audio source 102 and first wireless headphone 104 or second wireless headphone 106 (e.g., the access code according to the Bluetooth protocol). Demodulation module 606 may perform the demodulation function to calculate the carrier synchronization error. Carrier synchronization error may be determined based on the frequency offset between the carrier wave of the received single-channel audio signal and the local oscillation of first wireless headphone 104 or second wireless headphone 106 (e.g., the crystal oscillation frequency of clock oscillator 612).

Clock frequency module 608 in this example may be operatively coupled to demodulation module 606 and PLL 610 and configured to adjust the frequency of the local clock based on the at least one synchronization error (e.g., the timing synchronization error and/or the carrier synchronization error). Clock frequency module 608 may adjust the local oscillation frequency of clock oscillator 612 via PLL 610 to match the remote oscillation frequency of the clock of audio source 102. In some embodiments, the timing synchronization error alone may be used by clock frequency module 608 to adjust the local clock. In the example of the Bluetooth communication, the received sequence in the received single-channel audio signal known by audio source 102 and first or second wireless headphone 104 or 106 may be used to match or correlate the local sequence which may have timing offset with the received known sequence. The timing offset between the local sequence and the received known sequence is the timing synchronization error in this example. In some embodiments, the carrier timing synchronization error may be used as well by clock frequency module 608 to tune the local clock to further improve the clock synchronization.

In this example, timing module 616 may be operatively coupled to demodulation module 606 and configured to synchronize the timing synchronization signal with the left-channel audio signal or the right-channel audio signal. Timing module 616 may receive the timing synchronization signal from demodulation module 606 and align the timing synchronization signal with the slot start of the left-channel audio signal or the right-channel audio signal. The examples of the slot start are shown above in FIGS. 4 and 5 for multiple-slots packets and single-slot packets transmissions in the Bluetooth communication.

Figure 7:
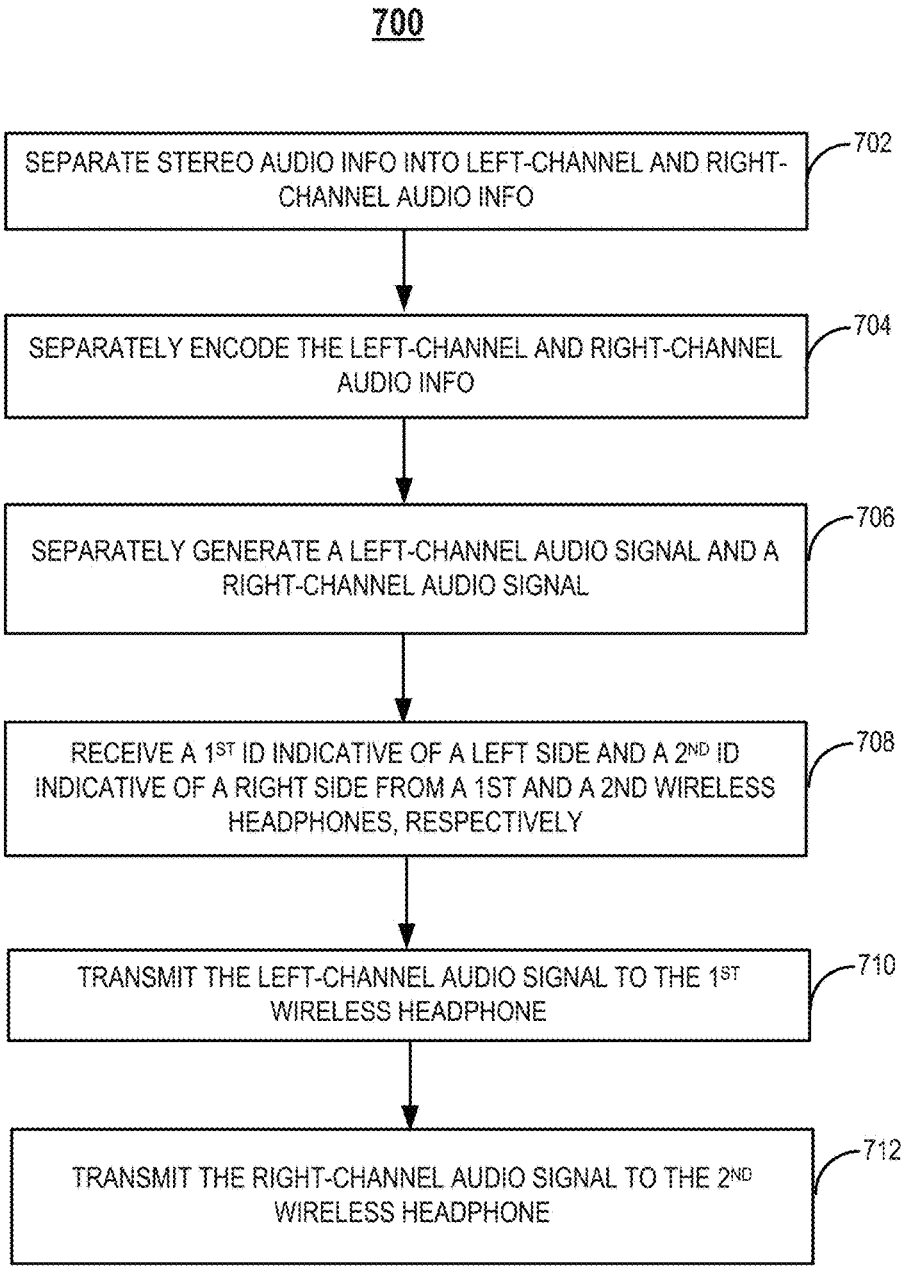
FIG. 7 is a flow chart illustrating an exemplary method for wirelessly communicating stereo audio information in accordance with an embodiment.

FIG. 7 is a flow chart illustrating an exemplary method 700 for wirelessly communicating audio information in accordance with an embodiment. Method 700 can be performed by processing logic that can comprise hardware (e.g., circuitry, dedicated logic, programmable logic, microcode, etc.), software (e.g., instructions executing on a processing device), or a combination thereof. It is to be appreciated that not all operations may be needed to perform the disclosure provided herein. Further, some of the operations may be performed simultaneously, or in a different order than shown in FIG. 7, as will be understood by a person of ordinary skill in the art.

Method 700 shall be described with reference to FIGS. 1 and 2. However, method 700 is not limited to that exemplary embodiment. Starting at 702, stereo audio information is separated into left-channel audio information and right-channel audio information. In some embodiments, decoder 202 of audio source 102 may decode stereo audio information and separate the decoded stereo audio information into the left-channel audio information and right-channel audio information.

At 704, the left-channel audio information and right-channel audio information is separately encoded. The encoding may be performed based on any suitable codecs, such as Opus codec. In some embodiments, encoder 204 of audio source 102 may separately encode the left-channel audio information and right-channel audio information.

At 706, a left-channel audio signal and a right-channel audio signal are separately generated based on the left-channel audio information and right-channel audio information, respectively. The left-channel audio signal and right-channel audio signal may be generated using a short-range wireless communication protocol, such as the Bluetooth or WiFi protocol. In some embodiments, RF module 206 of audio source 102 may generate the single-channel audio signal by modulating the corresponding single-channel audio information with a carrier wave at an RF band according to the Bluetooth or WiFi protocol.

At 708, a first identifier indicative of a left side and a second identifier indicative of a right side are received from a first wireless headphone and a second wireless headphone, respectively. Based on the left-side and right-side identifiers, the audio source can match each single-channel audio signal to the corresponding wireless headphone. In some embodiments, RF module 206 of audio source 102 may receive the left-side and right-side identifiers.

At 710, the left-channel audio signal is transmitted to the first wireless headphone based on the left-side identifier using the short-range wireless communication protocol, such as the Bluetooth or WiFi protocol. At 712, the right-channel audio signal is transmitted to the second wireless headphone based on the right-side identifier using the short-range wireless communication protocol, such as the Bluetooth or WiFi protocol. The left-channel audio signal and right-channel audio signal may be simultaneously and separately transmitted to the corresponding wireless headphones according to their left-side and right-side identifiers. In some embodiments, RF module 206 of audio source 102 may separately transmit the left-channel audio signal and the right-channel signal to first wireless headphone 104 and second wireless headphone 106, respectively, using the short-range wireless communication protocol.

Figure 8:
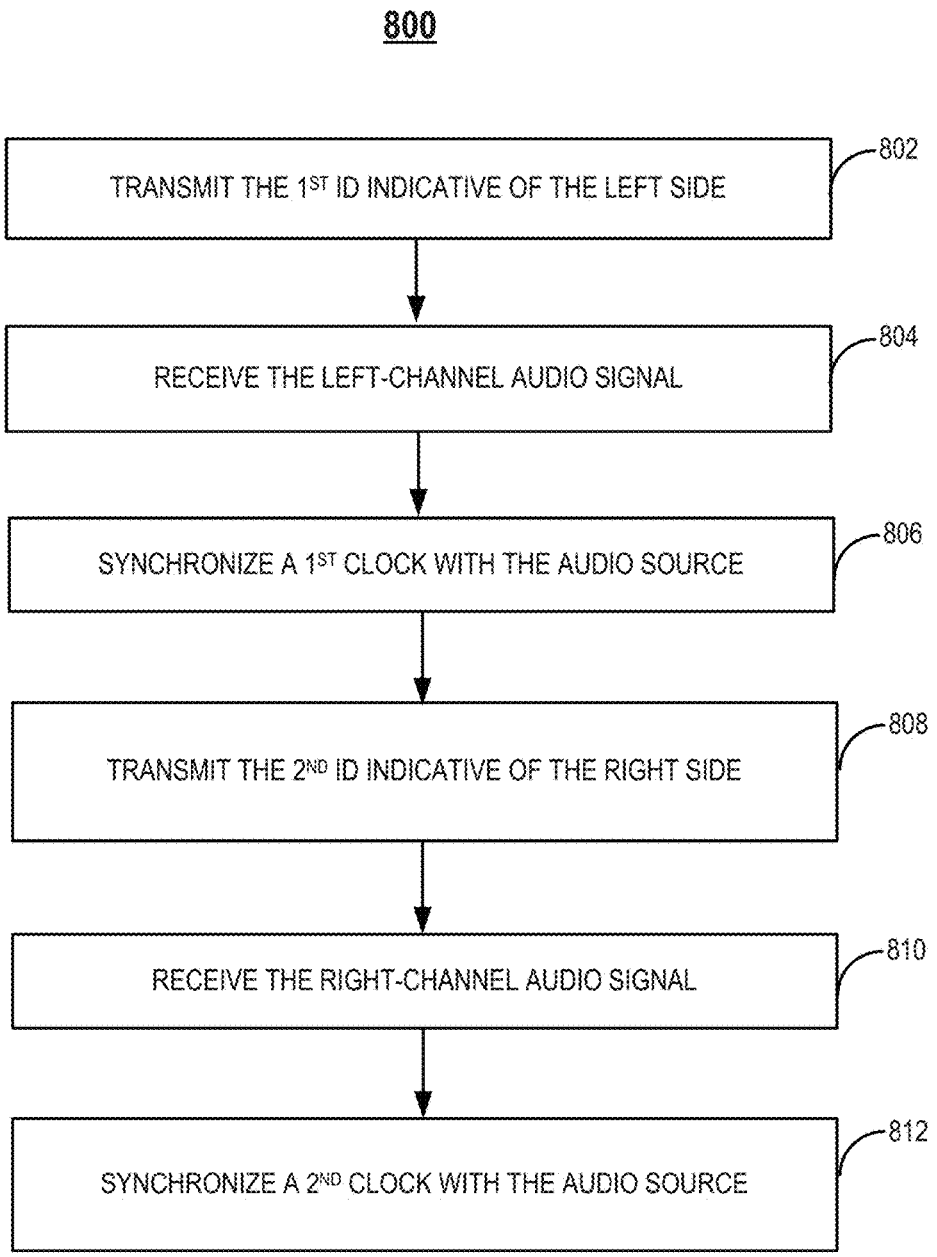
FIG. 8 is a flow chart illustrating an exemplary method for synchronizing wireless headphones in accordance with an embodiment.

FIG. 8 is a flow chart illustrating another exemplary method 800 for synchronizing wireless headphones in accordance with an embodiment. Method 800 can be performed by processing logic that can comprise hardware (e.g., circuitry, dedicated logic, programmable logic, microcode, etc.), software (e.g., instructions executing on a processing device), or a combination thereof. It is to be appreciated that not all operations may be needed to perform the disclosure provided herein. Further, some of the operations may be performed simultaneously, or in a different order than shown in FIG. 8, as will be understood by a person of ordinary skill in the art.

Method 800 shall be described with reference to FIG. 1. However, method 800 is not limited to that exemplary embodiment. Starting at 802, the first identifier indicative of the left side is transmitted to the audio source. In some embodiments, first wireless headphone 104 may work as the left-ear headphone and transmit the first identifier indicative of the left side to audio source 102. At 804, the left-channel audio signal may be received using the short-range wireless communication protocol, such as the Bluetooth or WiFi protocol. In some embodiments, first wireless headphone 104 may receive the left-channel audio signal 212*a* from audio source 102 using the short-range wireless communication protocol. At 806, the clock of the first wireless headphone is synchronized with the audio source based on the left-channel audio signal. In some embodiments, first wireless headphone 104 may synchronize its local clock with the remote clock (e.g., Bluetooth clock) of audio source 102 based on left-channel audio signal 212*a*.

Starting at 808, the second identifier indicative of the right side is transmitted to the audio source. In some embodiments, second wireless headphone 106 may work as the right-ear headphone and transmit the second identifier indicative of the right side to audio source 102. At 810, the right-channel audio signal may be received using the short-range wireless communication protocol, such as the Bluetooth or WiFi protocol. In some embodiments, second wireless headphone 106 may receive the right-channel audio signal 212*b* from audio source 102 using the short-range wireless communication protocol. At 812, the clock of the second wireless headphone is synchronized with the audio source based on the right-channel audio signal, so that the clocks of the first and second wireless headphones are synchronized. In some embodiments, second wireless headphone 106 may synchronize its local clock with the remote clock (e.g., Bluetooth clock) of audio source 102 based on right-channel audio signal 212*b*. As a result, the local clocks of first and second wireless headphones 104 and 106 can be indirectly synchronized via audio source 102.

Figure 9:
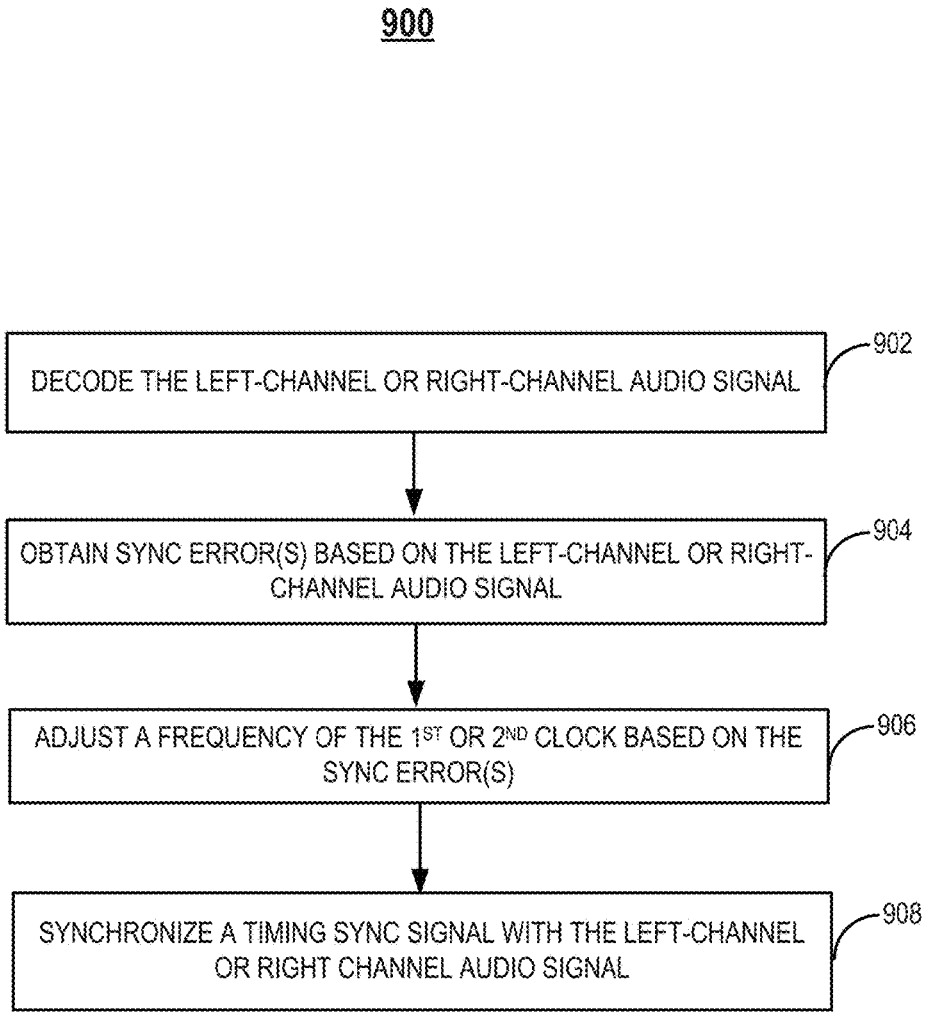
FIG. 9 is a flow chart illustrating another exemplary method for synchronizing wireless headphones in accordance with an embodiment.

FIG. 9 is a flow chart illustrating another exemplary method 900 for synchronizing wireless headphones in accordance with an embodiment. Method 900 can be performed by processing logic that can comprise hardware (e.g., circuitry, dedicated logic, programmable logic, microcode, etc.), software (e.g., instructions executing on a processing device), or a combination thereof. It is to be appreciated that not all operations may be needed to perform the disclosure provided herein. Further, some of the operations may be performed simultaneously, or in a different order than shown in FIG. 9, as will be understood by a person of ordinary skill in the art.

Method 900 shall be described with reference to FIG. 6. However, method 900 is not limited to that exemplary embodiment. Starting at 902, the left-channel audio signal or right-channel audio signal is decoded. The decoding may be performed based on Opus codec if the corresponding left-channel or right-channel audio information has been decoded based on Opus codec. In some embodiments, first wireless headphone 104 may include a decoder for decoding the left-channel audio signal, and second wireless headphone 106 may include a decoder for decoding the right-channel audio signal.

At 904, at least one synchronization error is obtained based on the left-channel audio signal or right-channel audio signal. The synchronization error may include a timing synchronization error and or a carrier synchronization error. In some embodiments, demodulation module 606 of first wireless headphone 104 or second wireless headphone 106 may receive the respective left-channel or right-channel audio signal in the digital form (e.g., converted by D/A converter 604) and perform the synchronization and demodulation functions to obtain the timing synchronization error and/or the carrier synchronization error.

At 906, the frequency of the clock of the first wireless headphone (first clock) or the clock of the second wireless headphone (second clock) is adjusted based on the at least one synchronization error. In one example, the timing synchronization error alone may be used for adjusting the crystal oscillator frequency of the first or second clock to match the clock frequency of the audio source. In another example, in addition to the timing synchronization error, the carrier synchronization error may be used as well for adjusting the crystal oscillator frequency of the first or second clock to match the clock frequency of the audio source. In some embodiments, clock frequency module 608 of first wireless headphone 104 or second wireless headphone 106 may adjust, based the timing synchronization error and/or the carrier synchronization error, the crystal oscillator frequency of clock oscillator 612 via PLL 610 to match the remote clock frequency of audio source 102.

At 908, a timing synchronization signal is synchronized with the left-channel audio signal or the right-channel audio signal. For example, the timing synchronization signal may be obtained from the received single-channel audio signal and aligned with a slot start of the respective left-channel audio signal or right-channel audio signal regardless of whether the audio signal is transmitted as single-slot packets or multiple-slots packets. In some embodiments, timing module 616 of first wireless headphone 104 or second wireless headphone 106 may receive the timing synchronization signal obtained by demodulation 606 and align the timing synchronization signal with the slot start of the respective left-channel audio signal or right-channel audio signal received from audio source 102. As a result, the clock synchronization between first wireless headphone 104 or second wireless headphone 106 and audio source 102 can be achieved.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure or the appended claims in any way.

While the present disclosure has been described herein with reference to exemplary embodiments for exemplary fields and applications, it should be understood that the present disclosure is not limited thereto. Other embodiments and modifications thereto are possible, and are within the scope and spirit of the present disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

The breadth and scope of the present disclosure should not be limited by any of the above-described exemplary embodiments, but should be defined only in accordance with the following claims and their equivalents.

What is claimed is:

1. A wireless audio system, comprising:

an audio source configured to separately transmit a left-channel audio signal and a right-channel audio signal using a short-range wireless communication protocol, wherein the left-channel audio signal and the right-channel audio signal are transmitted according to a time slot having a slot start;

a first wireless headphone configured to receive the left-channel audio signal and synchronize a first clock of the first wireless headphone with the audio source based on the left-channel audio signal; and a second wireless headphone configured to receive the right-channel audio signal and synchronize a second clock of the second wireless headphone with the audio source based on the right-channel audio signal, so that the first clock of the first wireless headphone is synchronized with the second clock of the second wireless headphone, and timings of the first wireless headphone and the second wireless headphone are aligned with the slot start, wherein the audio source comprises:

a decoder configured to separate stereo audio information into left-channel audio information and right-channel audio information;

an encoder operatively coupled to the decoder and configured to separately encode the left-channel audio information and the right-channel audio information; and a radio frequency (RF) module operatively coupled to the encoder and configured to separately generate the left-channel audio signal based on the encoded left-channel audio information and generate the right-channel audio signal based on the encoded right-channel audio information.

2. The wireless audio system of claim 1, wherein each of the left-channel audio information and the right-channel audio information is encoded based on Opus codec.

3. The wireless audio system of claim 1, wherein the short-range wireless communication protocol comprises a BLUETOOTH protocol.

4. The wireless audio system of claim 1, wherein the audio source is further configured to:

receive, from the first wireless headphone, a first identifier indicative of a left side;

transmit the left-channel audio signal to the first wireless headphone based on the first identifier;

receive, from the second wireless headphone, a second identifier indicative of a right side; and transmit the right-channel audio signal to the second wireless headphone based on the second identifier.

5. The wireless audio system of claim 1, wherein each of the first and second wireless headphones comprises:

a synchronization module configured to obtain at least one synchronization error based on the respective left-channel audio signal or right-channel audio signal;

a clock frequency module configured to adjust a frequency of the first clock or second clock based on the respective at least one synchronization error; and a timing module configured to synchronize a timing synchronization signal with the respective left-channel audio signal or right-channel audio signal.

6. The wireless audio system of claim 5, wherein the at least one synchronization error comprises a timing synchronization error and a carrier synchronization error.

7. The wireless audio system of claim 5, wherein the timing synchronization signal is aligned with the slot start of the respective left-channel audio signal or right-channel audio signal.

8. A method for synchronizing wireless headphones, comprising:

separately transmitting, by an audio source, a left-channel audio signal and a right-channel audio signal using a short-range wireless communication protocol, wherein the left-channel audio signal and the right-channel audio signal are transmitted according to a time slot having a slot start;

receiving, by a first wireless headphone, the left-channel audio signal from the audio source using the short-range wireless communication protocol;

synchronizing, by the first wireless headphone, a first clock of the first wireless headphone with the audio source based on the left-channel audio signal;

receiving, by a second wireless headphone, the right-channel audio signal from the audio source using the short-range wireless communication protocol; and synchronizing, by the second wireless headphone, a second clock of the second wireless headphone with the audio source based on the right-channel audio signal, so that the first clock of the first wireless headphone is synchronized with the second clock of the second wireless headphone, and timings of the first wireless headphone and the second wireless headphone are aligned with the slot start wherein separately transmitting the left-channel audio signal and the right-channel audio signal comprises:

separating stereo audio information into left-channel audio information and right-channel audio information;

separately encoding the left-channel audio information and the right-channel audio information; and separately generating the left-channel audio signal based on the encoded left-channel audio information and generate the right-channel audio signal based on the encoded right-channel audio information.

9. The method of claim 8, further comprising:

transmitting, by the first wireless headphone, a first identifier indicative of a left side to the audio source; and transmitting, by the second wireless headphone, a second identifier indicative of a right side to the audio source.

10. The method of claim 8, further comprising:

decoding, by each of the first and second wireless headphones, the respective left-channel audio signal or right-channel audio signal based on Opus Codec.

11. The method of claim 8, wherein synchronizing comprises:

obtaining, by each of the first and second wireless headphones, at least one synchronization error based on the respective left-channel audio signal or right-channel audio signal;

adjusting, by each of the first and second wireless headphones, a frequency of the first clock or second clock based on the respective at least one synchronization error; and synchronizing, by each of the first and second wireless headphones, a timing synchronization signal with the respective left-channel audio signal or right-channel audio signal.

12. The method of claim 11, wherein the timing synchronization signal is aligned with the slot start of the respective left-channel audio signal or right-channel audio signal.

13. A wireless audio system, comprising:

an audio source configured to separately transmit a left-channel audio signal and a right-channel audio signal using a short-range wireless communication protocol, wherein the left-channel audio signal and the right-channel audio signal are transmitted according to a time slot having a slot start;

a first wireless headphone configured to receive the left-channel audio signal and synchronize a first clock of the first wireless headphone with the audio source based on the left-channel audio signal; and a second wireless headphone configured to receive the right-channel audio signal and synchronize a second clock of the second wireless headphone with the audio source based on the right-channel audio signal, so that the first clock of the first wireless headphone is synchronized with the second clock of the second wireless headphone, and timings of the first wireless headphone and the second wireless headphone are aligned with the slot start, wherein each of the first and second wireless headphones comprises:

a synchronization module configured to obtain at least one synchronization error based on the respective left-channel audio signal or right-channel audio signal;

a clock frequency module configured to adjust a frequency of the first clock or second clock based on the respective at least one synchronization error; and a timing module configured to synchronize a timing synchronization signal with the respective left-channel audio signal or right-channel audio signal.

14. A method for synchronizing wireless headphones, comprising:

separately transmitting, by an audio source, a left-channel audio signal and a right-channel audio signal using a short-range wireless communication protocol, wherein the left-channel audio signal and the right-channel audio signal are transmitted according to a time slot having a slot start;

receiving, by a first wireless headphone, the left-channel audio signal from the audio source using the short-range wireless communication protocol;

synchronizing, by the first wireless headphone, a first clock of the first wireless headphone with the audio source based on the left-channel audio signal;

receiving, by a second wireless headphone, the right-channel audio signal from the audio source using the short-range wireless communication protocol; and synchronizing, by the second wireless headphone, a second clock of the second wireless headphone with the audio source based on the right-channel audio signal, so that the first clock of the first wireless headphone is synchronized with the second clock of the second wireless headphone, and timings of the first wireless headphone and the second wireless headphone are aligned with the slot start, wherein synchronizing comprises:

obtaining, by each of the first and second wireless headphones, at least one synchronization error based on the respective left-channel audio signal or right-channel audio signal;

adjusting, by each of the first and second wireless headphones, a frequency of the first clock or second clock based on the respective at least one synchronization error; and synchronizing, by each of the first and second wireless headphones, a timing synchronization signal with the respective left-channel audio signal or right-channel audio signal.

* * * * *